US005878933A

United States Patent [19]

Laughery

[11] Patent Number: 5,878,933

[45] Date of Patent: Mar. 9, 1999

[54] STRIP GUIDING APPARATUS AND ASSOCIATED METHOD FOR MAINTAINING LATERAL POSITION

[76] Inventor: Harry E. Laughery, 115 Park Pl., Monroeville, Pa. 15146

[21] Appl. No.: 974,856

[22] Filed: Nov. 20, 1997

Related U.S. Application Data

[63] Continuation-in-part of Ser. No. 544,803, Oct. 18, 1995, abandoned.

[51] Int. Cl.[6] ..... B65H 26/02; B65H 20/00

[52] U.S. Cl. ..... 226/21; 226/1; 226/44

[58] Field of Search ..... 226/1, 21, 22, 226/23, 44; 242/615.21

[56] References Cited

U.S. PATENT DOCUMENTS

| | | | |
|---|---|---|---|
| 2,291,830 | 8/1942 | Obenshain | 226/23 |
| 2,722,415 | 11/1955 | Wood, Jr. | 226/23 |
| 4,174,171 | 11/1979 | Hamaker et al. | 226/23 X |
| 4,212,419 | 7/1980 | Huber | 226/23 |
| 4,235,358 | 11/1980 | Klein | 226/22 |
| 4,572,417 | 2/1986 | Joseph et al. | 226/21 X |
| 5,276,460 | 1/1994 | Miyajima | 226/23 |
| 5,470,005 | 11/1995 | King et al. | 226/1 |

FOREIGN PATENT DOCUMENTS

| | | | |
|---|---|---|---|
| 525230 | 5/1956 | Canada | 226/22 |
| 2407842 | 8/1975 | Germany | 226/21 |

*Primary Examiner*—Michael Mansen

*Attorney, Agent, or Firm*—Benjamin T. Queen, II; Arnold B. Silverman; Eckert Seamans Cherin & Mellott LLC

[57] ABSTRACT

Strip guiding apparatus includes a roll rotatable about its longitudinal axis over which strip will travel while under tension. Sensing apparatus determines the lateral position of the strip with respect to the desired position and emits signals to control apparatus which will effect responsive rotation of support apparatus in order to effect rotation of the roll about a second axis which is spaced from and oriented generally perpendicular to the roll longitudinal axis responsive to lateral movement of the strip in relation to the desired position. Drive apparatus effects rotation of the support apparatus responsive to receipt of signals from the control apparatus in order to move the strip toward the desired position. Apparatus is also provided for measuring strip tension and emitting signals to tension controlling apparatus to adjust tension where it is not within a desired range. The drive apparatus is adapted to effect rotation of the roll about the second axis in either rotatable direction and up to about 15 degrees in each direction. An associated method is provided.

24 Claims, 4 Drawing Sheets

STRIP GUIDING APPARATUS AND ASSOCIATED METHOD FOR MAINTAINING LATERAL POSITION

CROSS REFERENCE TO RELATED APPLICATION

This application is a continuation-in-part of U.S. Ser. No.08/544,803, filed on Oct. 18, 1995.

BACKGROUND OF THE INVENTION

1. Field of the Invention

This invention relates to an apparatus and an associated method for rapidly and efficiently maintaining the desired lateral position of an elongated strip on a rotatable roll and also provides means for monitoring and controlling the tension on said strip.

2. Description of the Prior Art

It has long been known to store strip materials in coils and for various purposes to transfer the strip from a first coil to one or more second coils with the strip moving at a rapid rate between such coils. Numerous types of processing of the strip as it moves from a first coil to one or more second coils may be provided such as, for example, in the case of steel, galvanizing the strip. It is also known to slit the strip longitudinally so that a single coil strip moves from a first coil onto a plurality of smaller coils having strip of a reduced width as compared with the original strip. Any number of additional processes including coating of the strip, thermal treatment of the strip, laminating of the strip are known. Other examples of such processing lines are rolling mills and paper and plastic processing lines.

In such operations it is conventional to have one or more intermediate driven or idler rolls which serve to support the strip and maintain its movement in the desired direction. It is important that such strip be caused to track along the desired path of movement to resist unwanted deviations in the processing or treatment of the strip edges through physical contact with other components of the equipment.

U.S. Pat. No. 2,722,415 discloses an apparatus for guiding a sheet wherein the apparatus includes an axially moveable roll which is mounted for axial movement through interconnection with a vertical pivot shaft. The pivot shaft provides for rotation about an axis perpendicular to the general plane of travel of the sheet and, furthermore, provides only for single plane guiding of the sheet, i.e., the sheet travels between two spaced elements disposed in general parallelism in a common plane.

German Patent 2,407,842 discloses a strip guiding apparatus having a rotatable roll and a rotatable support means for rotating the roll. The support shaft remains vertical at all times while the strip may be offset to provide a wrap angle for the strip to effect the required friction of the strip on the roll.

It has also been known to employ devices, such as bridle rolls or pinch rolls, or other holdback or pulling means to facilitate maintaining the desired strip tension.

Despite the foregoing known means, there remains a very real and substantial need for improved, rapid acting automated systems that will effectively cause strip to track on rolls which are rotatably supporting the strip during movement without effecting unwanted edge strain or tension causing stretching of the strip edges and other undesirable results.

SUMMARY OF THE PRESENT INVENTION

The present invention has met the above-described need by providing an apparatus and associated method which will automatically and rapidly effect compensating rotational movement of a strip supporting roll in order to laterally displace strip to position it in the desired tracking location.

A preferred form of the apparatus has an axially rotatable idler roll over which the strip will travel while under tension. Sensing means determine the lateral position of the strip with respect to the desired position and emit responsive signals to control means. Rotatable support means for rotating the roll about a second axis spaced from oriented generally perpendicular to the roll axis to create responsive lateral movement of the strip are provided. Drive means serve to rotate the support means responsive to receipt of signals from the control means indicative of the strip being out of the desired lateral position in order to move the strip toward the desired position.

The rotatable support means is positioned at an angle of about 45° to 80° with respect to the plane of the approaching strip and preferably includes an axially rotatable support shaft fixedly secured directly or indirectly to journal means which rotatably secure said roll. The roll is fixedly secured to an axial roll shaft rotatably secured within the journal means such that rotation of the support means about the second axis will effect rotation of the roll about said second axis.

Pressure sensing means are provided in order to measure tension in the strip. In a preferred embodiment, this measurement is employed to adjust the strip tension creating means upstream or downstream of the roll.

The method of guiding strip includes moving the strip under tension over an axially rotatable roll, sensing the lateral position of the strip with respect to the roll and when the strip position departs from a predetermined position, rotating the roll about a second axis oriented generally perpendicular to the roll axis to effect corrective lateral movement of the strip. The direction of rotation of the roll corresponds to the direction of the correction needed.

Means are provided in a preferred embodiment for measuring strip tension and employing those measurements to adjust strip tension means disposed upstream or downstream of the roll.

It is an object of the present invention to provide an apparatus and an associated method for steering strip material which is moving and under tension.

It is another object of the present invention to provide such a system which will minimize damage to the strip due to improper tracking of the strip.

It is a further object of the invention to provide such a system which will effect automated rapid adjustment so as to maintain the desired strip tracking without causing damaging edge strain or tension on the strip.

It is a further object of the invention to provide such a system which is adapted to establish and maintain the desired tension on the strip.

It is a further object of the present invention to provide such a system which will be rapid acting and yet not risk damage to the strip due to rapid adjustments being made in the path of travel.

It is a further object of the invention to provide such a system which may be created as part of the original equipment or retrofitted into an existing system.

These and other objects of the present invention will be more fully understood from the following description of the invention.

DESCRIPTION OF THE PREFERRED EMBODIMENTS

The term "strip" as employed herein means an elongated unitary piece of material which is sufficiently flexible as to be wrapped around a reel to form a coil. The strip may be made of a wide range of materials, alloys, and composites and laminates including, but not limited to ferrous metal, non-ferrous metal, paper and synthetic resinous plastic.

The term "guide" or "guiding" as employed herein means directing the strip within the desired course of travel.

Figure 1:
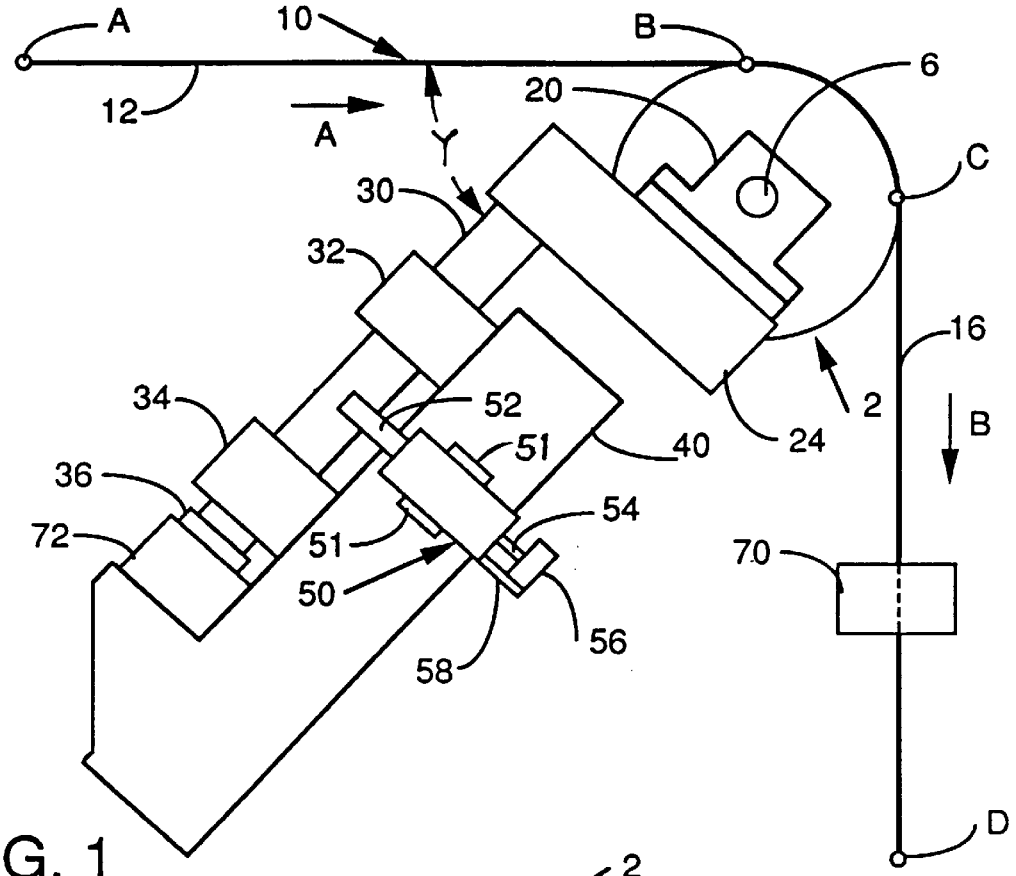
FIG. 1 is a partially schematic side elevation of a form of apparatus of the present invention.
Figure 2:
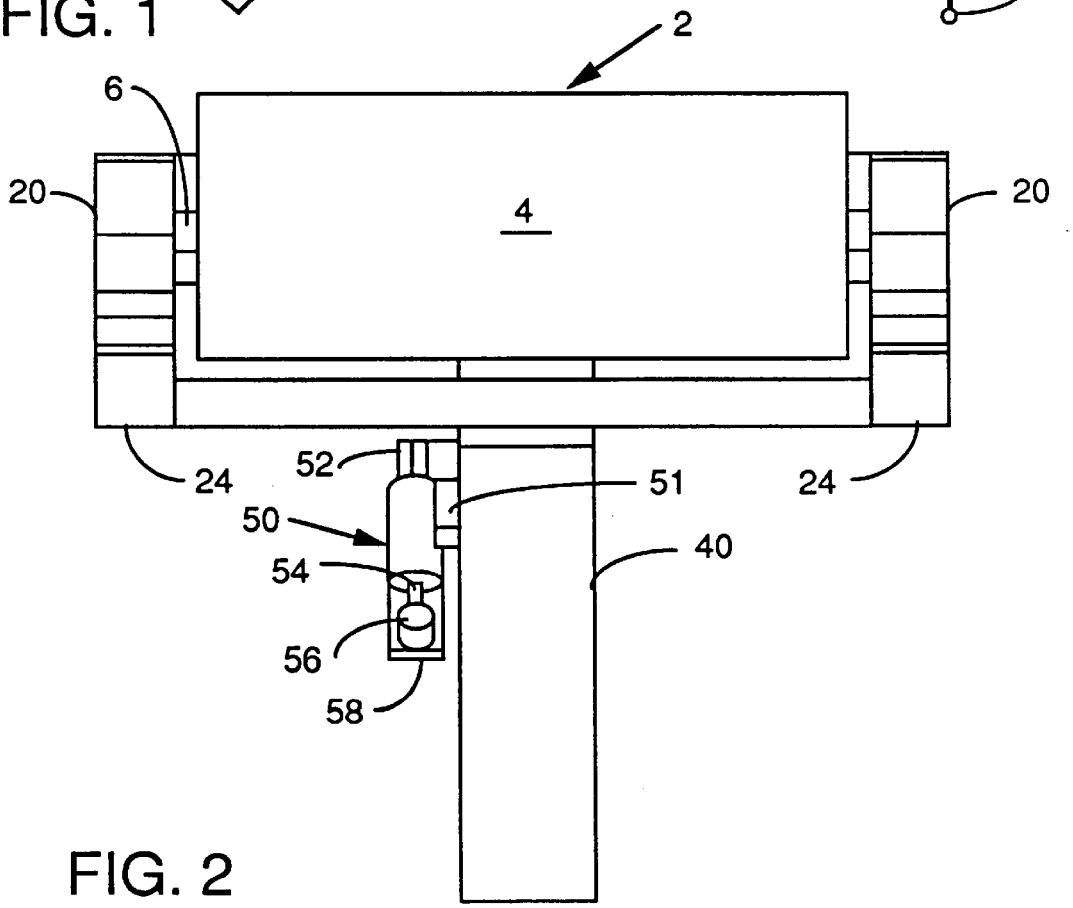
FIG. 2 is a partially schematic front elevation of a portion of the apparatus of FIG. 1 shown without the strip.

Referring to FIGS. 1 and 2, there is shown a cylindrical idler roll 2 having a strip engaging surface 4 and being fixedly secured to an axially positioned rotatable shaft 6 whereby roll 2 may be subjected to free axial rotation about its longitudinal axis while supported by shaft 6. A strip 10, in the form shown, has a generally horizontally moving portion 12 which is moving in the direction indicated by arrow A, has a portion between the letters B and C in surface-to-surface contact with the roll surface 4 and has a generally vertically downwardly projecting portion 16 moving in the direction indicated by arrow B. In this embodiment, the strip 10 under tension will, therefore, approach the roll 2 from a generally horizontal orientation and exit from contact with the roll 2 by moving generally vertically downwardly. The roll shaft 6 is rotatably supported within a pair of bearings or bushings 20 which receive opposite ends of shaft 6. The bearings or bushings 20 are supported by and fixedly secured to generally U-shaped structural support member 24 which are in underlying surface to surface contact with the bearings or bushings 20.

The support structure 24 is supported by a permanent stationary structural support 40.

Fixedly secured to the rear portion of the support structure 24 by any desired means, such as welding in abutting relationship, for example, is a rotatable support shaft 30 which is journaled in bearing or bushing means 32, 34 which are secured to support structure 40. Shaft 30 is supported at lower end by bearing block 36. It will be appreciated that the longitudinal axis of rotatable support member 30 is displaced from and oriented generally perpendicular with respect to the longitudinal axis of roll 2, which passes through shaft 6. Axial rotation of support shaft 30 in either rotational direction will, therefore, cause responsive rotation of the roll 2 about the longitudinal axis of shaft 30.

Stationary support member 40 supports drive means 50 which, in a manner to be described hereinafter in greater detail, effects axial rotation of support shaft 30 to effect rotation of the roll 2 about support shaft 30 when strip tracking compensation is desired. Drive means 50 may take the form of an electric motor or, in the preferred form, a hydraulic cylinder having an output shaft 52 which is operatively associated with shaft 30 in a manner to be described hereinafter in detail. In addition, the output shaft of hydraulic cylinder has a second component 54 which is operatively secured to position transducer 56, which is supported on pedestal 58. In a manner to be described hereinafter, movement of the output shaft 52 to rotate support shaft 30 effects corresponding movement of output shaft 54 and thereby permits the transducer 56 to emit a responsive electrical signal corresponding to the rotary position of shaft 30 and, therefore, the rotary position of roll 2 with respect to the longitudinal axis of support shaft 30.

As shown in FIG. 1, in the downstream portion 16 of the strip 10 is positioned sensing means 70, which serve to sense the position of the strip with respect to the desired track and emit signals to control means (not shown in this view), which will be discussed hereinafter. The control means, when the lateral position of the strip on the roll 2 is not what is desired, will issue a signal to the drive means 50 to thereby cause rotary motion of support shaft 30 in the desired direction and to the desired extent so as to cause the strip 2 to move laterally along the roll 2 to achieve the desired lateral position with respect to the roll 2. The drive means 50 is secured to fixed support 40 by bracket means 51. Transducer 56 provides an electrical signal to the control means to tell the control means when the desired correction has been achieved and thereby terminate operation of the drive means. The transducer 56, in a preferred embodiment, has a moving component with movement of this component varying the analog signal output to provide a reading of the position of shaft 30 and roll 2.

Another feature of the invention shown in FIG. 1 is the use of pressure sensing means 72 which is in underlying contact with the bearing block 36 and, as a result of axial load on the support shaft 30, applies a varying force to the pressure sensing unit 72 to thereby indicate the strip tension. This pressure sensing unit 72 which may, in the preferred embodiment, be a load cell, emits a signal which may be employed in a manner to be described hereinafter to provide a tension reading and adjust the tension in the strip if the strip tension is not at a desired level.

With the reference to FIG. 1, the horizontally oriented portion of the strip moves in the direction indicated by the arrow A and the generally vertical segment of the strip 16 moves in the direction indicated by arrow B. It will be appreciated that in order to minimize any edge strain or stretch, the total distance from points A to D on each side of the strip 10 must be the same. With the present invention, this distance can change on each side and it is the rotation of the roll about the axis of support shaft 30 in conjunction with the angle of support shaft 30 with respect to the incoming and exiting strip that corrects for this departure. For example, when the shaft is rotated, the distance from point A to point B in FIG. 1 will decrease on one side and the distance from point C to point D will increase by the same distance. On the other side of the strip, the distance from point A to point B increases, while the distance from point C to point D decreases by the same distance, thereby keeping the distance from points A to D on both sides or edges of the strip the same.

It will be appreciated that the support shaft 30 is positioned in the form shown in FIG. 1 at an angle of Y with respect to the plane of the approaching strip 10. In general, angle Y will be about 45° to 80° with respect to the plane of the approaching strip 10. The angular positioning of the support shaft 30 advantageously facilitates and enhances the ability of the strip guiding apparatus of the invention to guide and maintain a desired lateral position of the strip 10 as the strip 10 moves under tension. Further, the angular mounting of the support shaft 30 allows for the desired strip guiding effect without straining the edges of the strip 10 and with relatively low tension required to allow for effective operation of the pressure sensing means 72, as described herein.

While in the embodiment set forth in FIG. 1 the strip 10 has been shown and described as having a generally horizontally moving portion 12 approaching contact point B on roll 2 and a generally vertically downwardly projecting portion 16 leaving contact point C, the invention is not so limited. For example, the strip 10 may (a) approach horizontally and exit upwardly, downwardly or angularly or (b) may approach vertically upwardly or downwardly and exit horizontally or angularly, if desired. The positioning of the support shaft 30 at an angle of about 45° to 80° with respect to the plane of the approaching strip 10 remains true and accurate for whatever direction the strip 10 may be approaching the strip guiding apparatus.

Figure 3:
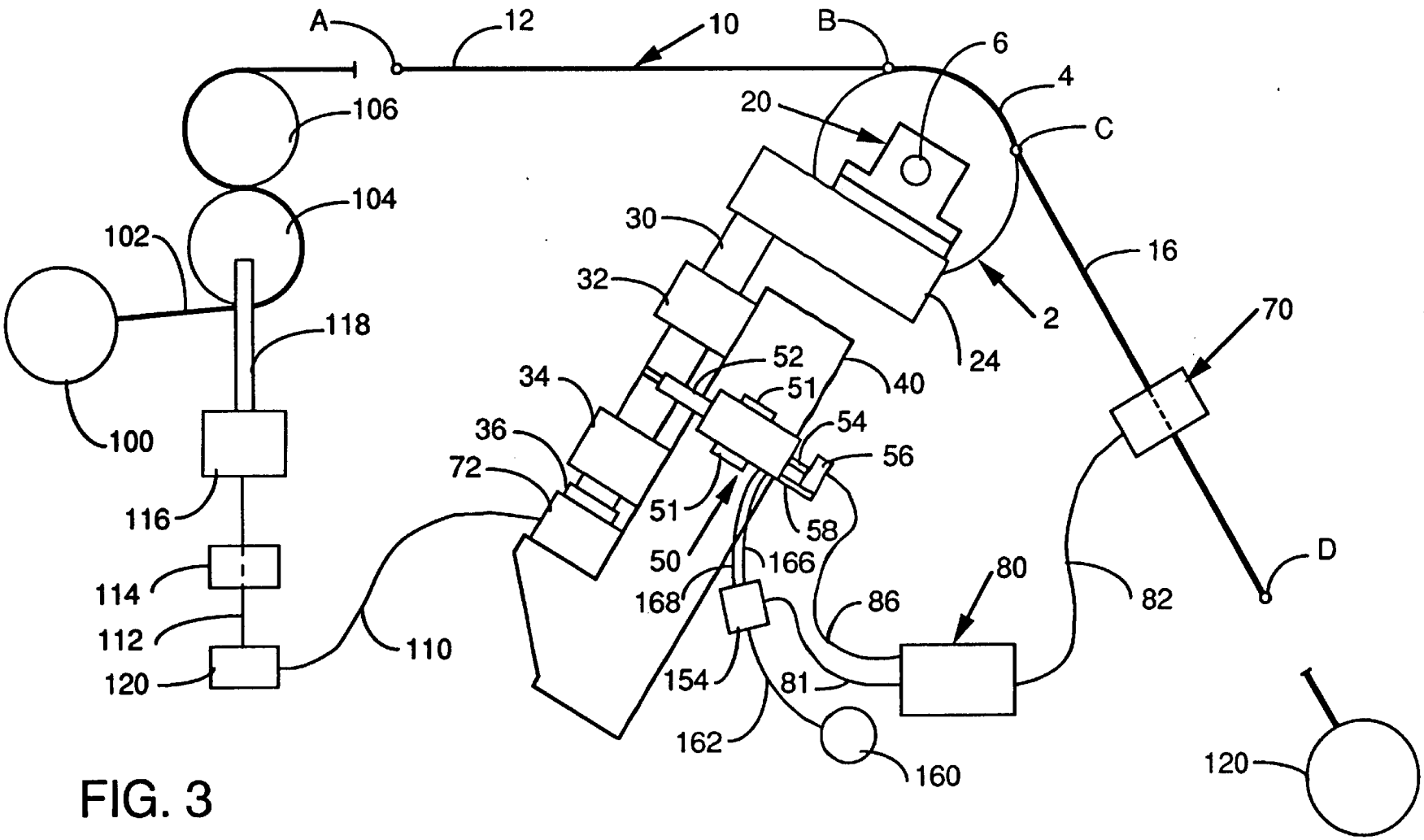
FIG. 3 is a partially schematic side elevation of apparatus of the present invention showing cooperating adjacent apparatus.

Referring to FIG. 3, it will be seen that the strip 10 has a section 12 approaching the roll 2 in a generally horizontal direction, a section in contact with surface 4 of roll 2 and has a downwardly extending section 16 which is at an angle with respect to the vertical. Control means 80, which may be in the form of a microprocessor receives output signals from sensing means 70 over lead 82 which provides an indication of the deviation of the lateral position of the strip 10 with respect to the desired position. When the lateral position has moved beyond a desired location, the control means 80 emits a signal over lead 81 to servo valve 154 to initiate action of the drive means 50 to effect axial rotation of support shaft 30 to thereby rotate roll 2 about shaft 30. Valve 154 receives hydraulic fluid from pump 160 in pipe 162 and directs the same to the drive means 50 in either pipe 166 or 168 depending on the desired direction of movement. When transducer 56 emits a signal over lead 86 to microprocessor 80 indicating that the degree of correction has been achieved, the control means terminates operation of the drive means 50 by an appropriate signal over lead 81. In one embodiment, the control means 80 may be an amplifier which boosts the voltage or amperage of the transducer output signal to the correct amperage and voltage needed to operate servo valve 154.

Referring to the left-hand portion of FIG. 3, a reel 100 has a portion 102 of the strip 10 emerging therefrom and passing through a pair of bridle rolls 104, 106 in order to facilitate establishing the desired tension in strip 10. The tension reading in pressure sensing means 72 produces an output over lead 110 to digital indicator controller 120 which sends an appropriate signal to tension bridle drive motor controller 114. The signal emitted from the digital indicator controller 120 to the bridle drive motor controller 114 is proportional to the strip tension and any deviation in the desired tension causes the signal to vary, thereby causing the bridle roll drive motor 116 which is mechanically connected by shaft 118 to the bridle roll assembly 104, 106 to increase or decrease the motor torque and, therefore, the strip tension responsively. Strip segment 16 is rewound on reel 120 to reestablish a coil.

It will be appreciated that between coil 100 and coil 120, whatever processing is desired for the strip has been accomplished and that the unit of this invention facilitates immediate, accurate and prompt tracking of the strip with respect to the desired lateral position. If desired, more than one unit of the present invention may be employed in a processing line.

It will be appreciated that where the system is not to be employed for monitoring the tension, this feature including the pressure sensing means 72 and associated controls may be eliminated.

Figure 4:
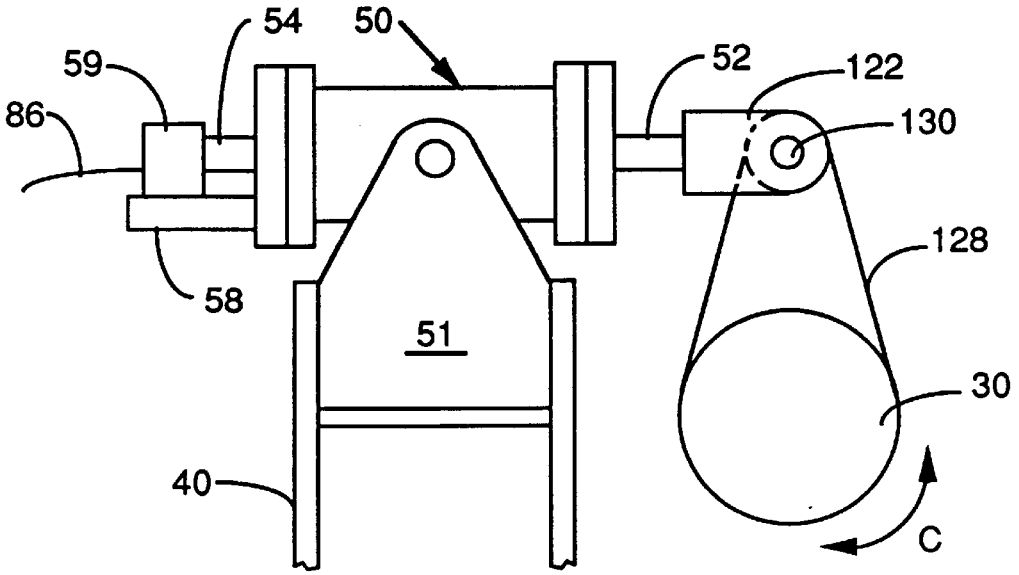
FIG. 4 is a detail of a preferred means for rotating the roll.

Referring now to FIG. 4, further details regarding the means for rotating support shaft 30 will be considered. The drive means in the form of hydraulic cylinder 50 is shown secured to the support member 40 by bracket means 51. The shaft 52 emerging from one side of the hydraulic cylinder 50 is engaged with apertured connector member 122 which is pivotally secured to plate-like member 128 by suitable mechanical fasteners, such as by pin member 130 with the plate-like member 128 being fixedly secured to shaft 130. It will be appreciated that as shaft 52 is reciprocated into and out of the housing of the cylinder 50, responsive rotation of support shaft 30 will be effected in the directions indicated by double-headed arrow C. The transducer member 59 similarly will be subjected to translational movement of a movable component thereof toward and away from the housing of hydraulic cylinder 50 through movement of shaft 54 which movement will provide an electrical signal which varies according to the position of the movable transducer component over lead 86 to provide a signal as to when the desired rotation of roll 2 about the second axis has been achieved.

It is contemplated that the degree of rotation in either direction of the support shaft 30 and, as a result, the roll 2, will be up to about 15 degrees with up to about 5 degrees being preferred.

Figure 5:
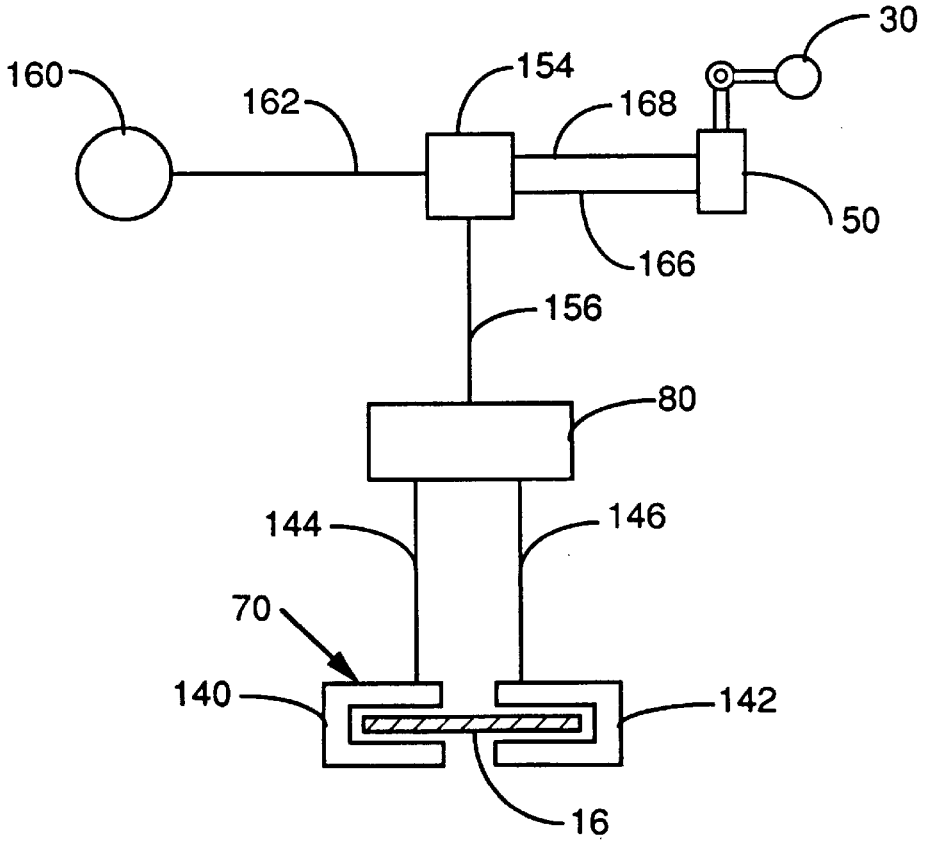
FIG. 5 is a schematic illustration showing a portion of the sensing and control means of the present invention.

Referring to FIG. 5, there is shown the sensor means 70 which, in the form shown, is a pair of non-contacting conductivity sensors 140, 142 which measure portions of a metal strip 16 which are not the edge and emit signals over respective leads 144, 146 to control means 80 which may be a suitable microprocessor programmed in a manner well known to those skilled in the art. A suitable form of sensor 140, 142 for metal strip is that sold under the trade designation North American H3119. When the sensor means 70 emits signals over leads 144, 146 such that when the control means 80 compare them with the desired position of the strip 16 indicate that the strip is not tracking as desired, an output signal from the controller means 80 over lead 156 to servo valve 154 which permits flow of fluid over line 162 from fluid pump 160. In this embodiment, the control means 80 may be an amplifier which controls the servo valve 154. When a signal indicating that the support shaft 30 should be rotated is delivered from control means 80 to valve 154 over electrical lead 156, pump 160 delivers fluid through pipe 162 to hydraulic cylinder 50 in pipe 166, or pipe 168, depending on which direction support shaft 30 is to be rotated.

For strip which is electrically nonconductive, the sensors may be edge sensors of the type known in the art, such as light sources cooperating with electro-optical sensors or an air type which senses back pressure in the air stream.

Figure 6:
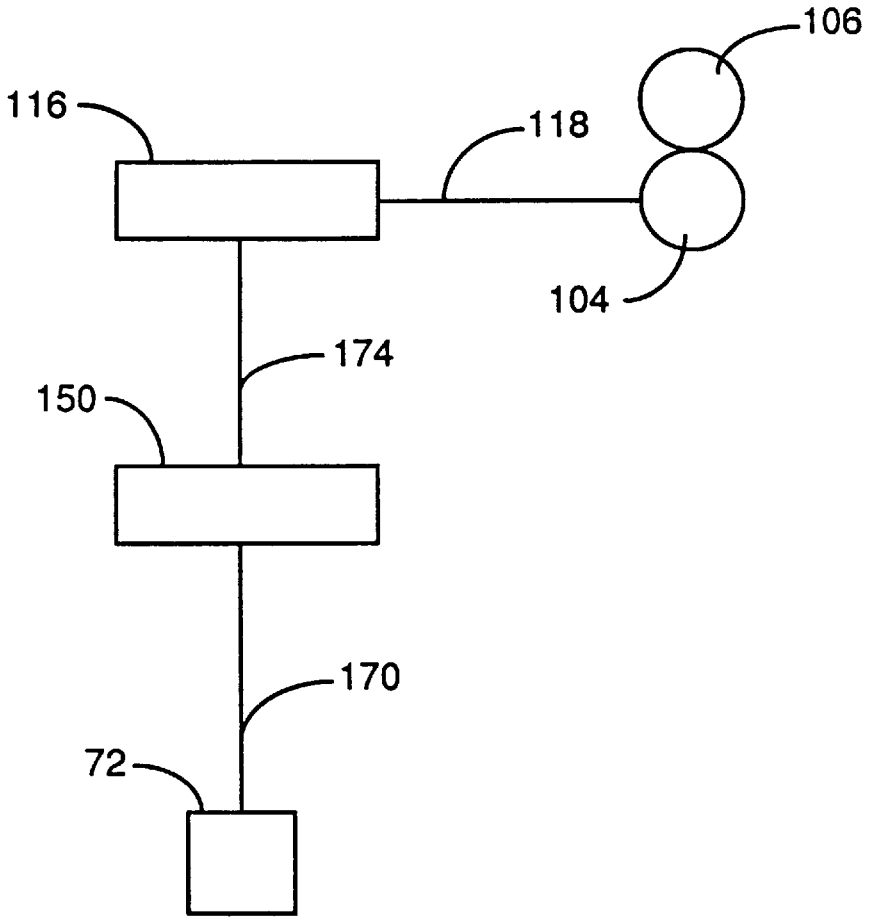
FIG. 6 illustrates a portion of the tension monitoring apparatus of the present invention.

Referring to FIG. 6, there is shown a means for employing pressure pad or load sensor 72 to control tension in the strip. The signal emitted from load cell 72 is responsive to tension on the strip 10, as shown in FIG. 1, transmitted by support shaft 30 through bearing block 36 to pressure pad 72. The load cell output in the form of electrical signal over lead 170 enters control means 150 and where an alteration in strip tension is desired, the control means 150 over lead 174 emits a signal which energizes motor 116 which, through output shaft 118, effects a desired change in tensioning as a result of physical movement of bridle rolls 104, 106.

It will be appreciated, therefore, that the present invention provides a rapid and effective means for maintaining the desired tracking of a strip moving under tension at a rapid speed in an automatic and effective manner. Also, to the extent desired, tension may be monitored and also controlled. All of this is accomplished in a reliable effective manner.

While for convenience of reference herein, reference has been made to an idler roll 2, if desired, the invention may be employed with a roll which is driven as by an electric, hydraulic or air motor, for example.

Whereas particular embodiments of the invention have been described above for purposes of illustration, it will be appreciated by those skilled in the art that numerous variations of the details may be made without departing from the invention as described in the appended claims.

I claim:

1. Strip guiding apparatus for maintaining a desired lateral position of said strip comprising an axially rotatable roll over which said strip will travel while said strip is under tension, sensing means for determining a lateral position of said strip with respect to said desired lateral position, control means for receiving signals from said sensing means related to said lateral position of said strip, rotatable support means for rotating said roll about a second axis so as to create responsive lateral movement of said strip on said roll, said second axis extending generally perpendicular to said roll axis, said support means positioned at an angle of about 45° to 80° with respect to the plane of said strip approaching said strip guiding apparatus, and drive means for rotating said support means responsive to receipt of a signal from said control means indicative of said strip deviating from said desired lateral position on said roll in order to move said strip toward said desired position.

2. The strip guiding apparatus of claim 1 including said rotatable support means including an axially rotatable support shaft, said roll being fixedly secured to an axially positioned support shaft which is rotatably secured within journal means, and said rotatable shaft being connected to said journal means such that rotation of said support shaft will effect responsive rotation of said roll shaft about said second axis.

3. The strip guiding apparatus of claim 2 including said drive means having means for rotating said rotatable support shaft in either rotational direction.

4. The strip guiding apparatus of claim 3 including said drive means having means for rotating said rotatable shaft up to about 15 degrees in each direction.

5. The strip guiding apparatus of claim 2 including pressure sensing means operatively associated with said rotatable support shaft to facilitate a determination of tension in said strip.

6. The strip guiding apparatus of claim 5 including said pressure sensing means being a load cell.

7. The strip guiding apparatus of claim 5 including means for delivering signals containing information regarding said strip tension to means upstream with respect to the direction of travel of said strip from said roll to facilitate maintaining desired tension in said strip.

8. The strip guiding apparatus of claim 1 including said sensor means having a pair of non-contacting conductivity sensing means which emit signals to said control means when said strip is not in said desired lateral position.

9. The strip guiding apparatus of claim 8 including said sensing means monitoring portions of said strip other than said longitudinal edges thereof.

10. The strip guiding apparatus of claim 1 including said drive means being hydraulic cylinder means.

11. The strip guiding apparatus of claim 1 including said sensing means having means for sensing the position of metal strip.

12. The strip guiding apparatus of claim 11 including said sensing means being disposed downstream in respect of the direction of strip travel from said roll.

13. The strip guiding apparatus of claim 1 including transducer means for monitoring the extent of roll rotation about said second axis.

14. A method of guiding strip moving over a roll rotatable about its longitudinal axis where said strip is under tension comprising sensing a lateral position of said strip with respect to a desired lateral position, and employing rotatable support means for rotating said roll about a second axis so as to effect corrective lateral movement of said strip when said strip position departs from said desired lateral position, said second axis extending generally perpendicular to said roll axis, said support means positioned at an angle of about 45° to 80° with respect to the plane of said strip approaching said guiding apparatus.

15. The method of claim 14 including effecting rotation of said roll about said second axis in either rotational direction depending upon the direction of correction desired.

16. The method of claim 15 including effecting said rotation of said roll about said second axis up to about 15 degrees.

17. The method of claim 16 including effecting said rotation about said second axis by rotating a shaft of said support means, said shaft operatively associated with means supporting said roll.

18. The method of claim 17 including employing control means to effect rotation of said shaft about said second axis responsive to signals received by said control means from said sensing means.

19. The method of claim 18 including effecting said sensing downstream of said roll with respect to the direction of travel of said strip.

20. The method of claim 19 including positioning said roll such that said strip will approach from a generally horizontal direction and leave in a generally downward direction.

21. The method of claim 20 including simultaneously with sensing said strip means measuring tension of said strip as it moves over said roll.

22. The method of claim 15 including employing said method with metal strip.

23. The method of claim 14 including delivering tension measurement signals to tension adjusting means to effect adjustment of tension when desired.

24. The method of claim 14 including employing transducer means to sense the extent of rotation of said roll about said second axis.

* * * * *